United States Patent [19]

Toyoda et al.

[11] 3,945,765

[45] Mar. 23, 1976

[54] REFRIGERANT COMPRESSOR

[75] Inventors: Hiroshi Toyoda, Isesaki; Shigemi Shimizu, Sakai; Kiyoshi Terauchi; Masaharu Hiraga, both of Isesaki, all of Japan

[73] Assignee: Sankyo Electric Co., Ltd., Japan

[22] Filed: Apr. 14, 1975

[21] Appl. No.: 568,001

[30] Foreign Application Priority Data

| | | |
|---|---|---|
| Apr. 15, 1974 | Japan | 49-42590[U] |
| Apr. 15, 1974 | Japan | 49-42591[U] |
| Sept. 10, 1974 | Japan | 49-109398[U] |
| July 10, 1974 | Japan | 48-78813 |

[52] U.S. Cl. ..... 417/269; 184/6.17

[51] Int. Cl.[2] ..... F04B 1/12; F01M 1/00

[58] Field of Search ..... 417/269; 184/6.17, 6.16; 64/469

[56] References Cited

UNITED STATES PATENTS

| | | | |
|---|---|---|---|
| 2,835,436 | 5/1958 | Steinhagen et al. | 417/269 |
| 3,085,514 | 4/1963 | Budzich | 417/269 |
| 3,712,759 | 1/1973 | Olson | 417/269 |
| 3,838,942 | 10/1974 | Pokorny | 417/269 |

*Primary Examiner*—William L. Freeh
*Assistant Examiner*—G. P. LaPointe
*Attorney, Agent, or Firm*—Carothers and Carothers

[57] ABSTRACT

A refrigerant compressor having pistons reciprocated in respective cylinders by a wobble plate driven by an input rotor which is secured on a drive shaft, which compressor has a reduced volume and an improved lubricant system. An end plate of a housing for the compressor supports and bears the drive shaft and is formed with an oil port extending from a shaft seal cavity mounting a shaft seal of the drive shaft to a gap between the end plate and the rotor, with the drive shaft being formed with another oil port extending between the shaft seal cavity and a gap between the rotor and the wobble plate whereby the lubricant oil flows through the gap between the rotor and the wobble plate, the oil port in the drive shaft, the shaft seal cavity, the oil port in the end plate, and the gap between the rotor and the end plate in that order. The rotor is formed with an annular recess on a surface thereof facing the end plate and in eccentricity from the rotating axis of the rotor. A valve plate secured between a cylinder block and a cylinder head is formed of a thin ground steel plate or a thin metal plate normally used for a spring and is formed with discharge and suction openings by punching. The cylinder head is formed with suction and discharge chambers partitioned with a partition wall means which has sharp end projections formed on an end surface thereof to bite into a gasket between the end of the partition wall and the valve plate to firmly secure the gasket. Two service valves are provided on a side surface of the housing which are communicated with the suction and discharge chambers, respectively, of the cylinder head through a hole extending in the cylinder block and the valve plate.

12 Claims, 8 Drawing Figures

REFRIGERANT COMPRESSOR

Background of the Invention

This invention relates to refrigerant compressors and, more particularly, to improvements in a refrigerant compressor wherein a piston is reciprocated by a wobble plate driven by a rotor which is secured on a drive shaft.

Such a refrigerant compressor which has pistons reciprocated by means of a wobble plate and a rotor, has been known in the prior art, as described in U.S. Pat. Nos. 3,552,886 (which is reissued under No. 27,844), 3,761,202 and 3,838,942. The refrigerant compressor is small in volume and is suitable for refrigeration systems of the automotive or mobile type.

But it is desirable that the refrigerant compressor be reduced in the volume while maintaining its efficiency.

One of the problems in such known compressors is the lubrication system. One of the above described three U.S. patents, or U.S. Pat. 3,383,942, discloses a recirculating blow-by lubrication system. According to that system, a flow port must be formed in a compressor housing which extends from a shaft seal cavity in one end plate of the housing to a suction chamber in a cylinder head. The lubrication oil flows into a cylinder through the suction chamber from the flow port and returns to a sump chamber through the cylinder. But a portion of the oil is mixed with the refrigerant gas in the suction chamber and the cylinder whereby it enters the refrigerant circuit, so that the oil contained in the sump chamber may be reduced. The oil entrained in the refrigerant gas undesirably stains the internal surface of piping members of the refrigerant circuit.

It is natural that the volume of the compressor housing may increase for the provision of the flow port.

Another problem concerns a valve plate which is secured between the cylinder block and the cylinder head. In a known method, the valve plate is formed of a cast steel plate or a sintered metal plate by machining openings for suction and discharged ports and by grinding the surface of the plate. Accordingly, the valve plate is expensive due to the complicated production method and is required to be thick in order to free the same from deformation in the grinding operation. The thick valve plate results in not only an increase of the volume of the compressor but also degraded refrigerant efficiency.

The cylinder head is formed with a suction chamber and with a discharge chamber. These two chambers are partitioned by a partition wall. When the cylinder head is assembled onto the cylinder block together with the valve plate having valve means, a gasket is secured between the end surface of the partition wall and the valve plate to provide a seal between the suction chamber and the discharge chamber. But, the gasket may be displaced and broken down when the differential pressure between the suction chamber and the discharge chamber is increased.

In practical use, two service valves (which are not disclosed in the above described U.S. patents) are provided the cylinder head which are used for the introduction of the refrigerant gas into the compressor, for the inspection of trouble and other services. The service valves are connected with the suction and discharge chambers, respectively, through ports formed in the cylinder head. But the provision of the service valves results in not only the complication of the cylinder head but also in increased volume of the cylinder head.

SUMMARY OF THE INVENTION

A general object of this invention is to provide a refrigerant compressor of a reduced volume and of a type as disclosed in the above described U.S. patents.

Another object of this invention is to provide a compressor of such a type which has an improved lubricant system.

Still another object of this invention is to provide a compressor having a thin and economical valve plate.

Yet another object of this invention is to provide a compressor having a gasket secured between the valve plate and the end surface of the partition wall of the cylinder head which is firmly secured so that the gasket is not removed by the differential pressure between the suction and discharge chambers.

Another object of this invention is to provide a compressor having service valves being provided on a side surface of the compressor housing but not on the cylinder head.

According to this invention, a refrigerant compressor having at least one piston reciprocated by means of a wobble plate means driven by an input rotor means and an input shaft means connected with the rotor means, is comprised of a housing for the compressor including a cylinder block for the at least one piston and a sump chamber adjacent the cylinder block housing, the wobble plate and the input rotor, a first end plate means on the housing including a journal bearing means for the input shaft, a shaft seal cavity and shaft seal means mounted on and around the input shaft in the shaft seal cavity, a second end plate means at the opposite end of the housing including refrigerant suction and discharge chambers and valve means selectively interconnecting the same with the cylinder block, first peripheral bearing means between the input rotor means and the first end plate means, second peripheral bearing means between the input rotor means and the wobble plate means, and lubrication oil contained in the sump chamber, which is characterized in that the input shaft has a first oil flow port extending from a first predetermined oil flow gap between the rotor means and the wobble plate to the shaft seal cavity and a second oil flow port communicating between the first oil flow gap and the journal bearing, the first end plate means comprising at least one third oil flow port extending from the shaft seal cavity to a second predetermined oil flow gap between the input rotor means and the first end plate means, and the input rotor means having an annular recess which is formed in a surface thereof facing said second oil flow gap and in eccentricity from the rotating axis of the rotor, whereby the lubrication oil flows from said sump chamber to the second oil flow gap through the first oil flow gap, the first and second oil flow ports, the shaft seal cavity and the third oil flow port, the oil being returned to the sump chamber from the second oil flow gap after serving The lubrication of the journal bearing means, the first and second peripheral bearing means and the shaft seal means. The radially inner wall edge of said annular recess of said input rotor means may be formed to project radially outwardly.

In the compressor, the second end plate means may comprise a cylinder head formed with the suction and discharge chambers which are partitioned by partition wall means, a valve plate which is secured between the cylinder head and the cylinder block and which has inlet openings in registry with the suction chamber and exhaust openings in registry with the discharge chamber, reed valve means provided on the valve plate for control of the inlet openings and of the exhaust openings in response to the operation of the compressor, gasket means being secured between the valve plate and an end surface of the partition wall means, and the partition wall means being formed with sharp projections which bite into the gasket to firmly secure the gasket.

The valve plate may be formed of a plate having a flat and smooth surface and which has a reduced thickness capable of being punched and pressed, and the valve plate is formed with punched inlet and exhaust openings.

The valve plate is formed of a thin plate selected from a ground steel plate and a spring steel plate.

The cylinder head may have an outlet port communicating with the discharge chamber, the cylinder block having two valve means provided on side surface thereof which are communicated with the suction and discharge chambers, respectively, through holes formed in the cylinder block and the valve plate, to provide service valves.

Further objects and features of this invention will be understood from following descriptions in connection with embodiments of this invention referring to the annexed drawings.

Detailed Description of Preferred Embodiments

Figure 1:
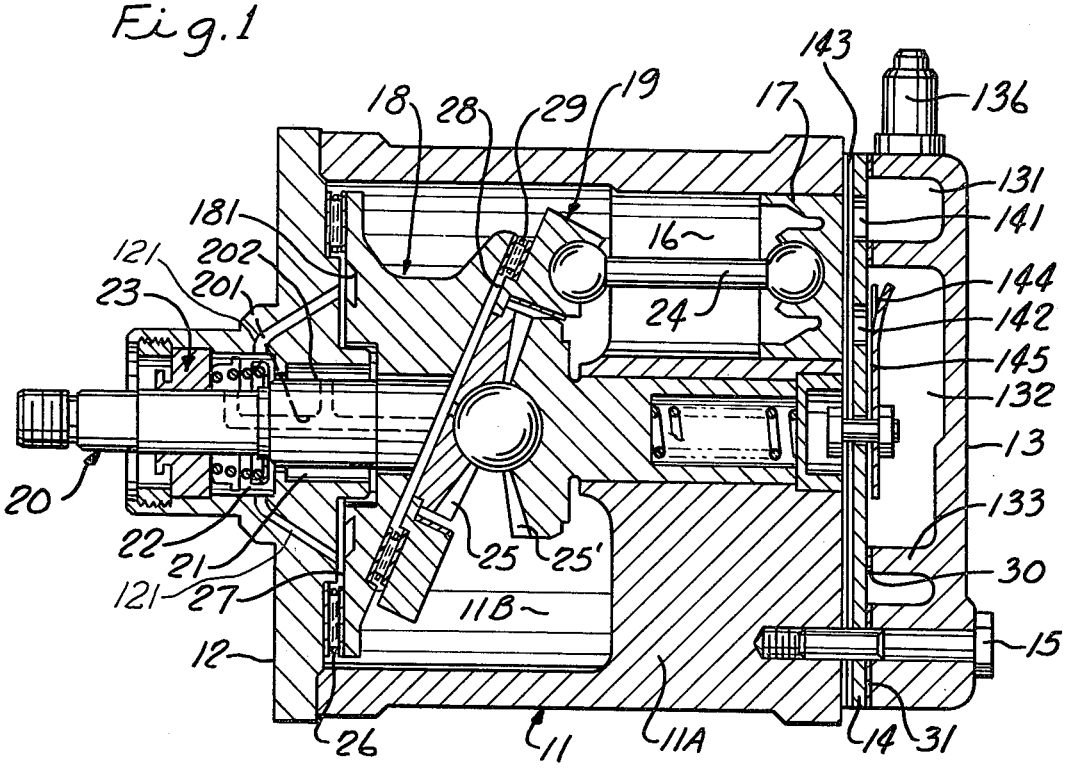
FIG. 1 shows a sectional view of an embodiment of this invention.

Referring to FIG. 1, which shows a refrigerant compressor according to this invention. The compressor comprises a housing 11 having a cylinder block 11A in one end thereof and a hollow portion 11B at the other.

The hollow portion 11B mounts a front cover plate 12 by means of screws and the cylinder block 11A mounts a cylinder head 13 and a valve plate 14 by means of bolts 15 to complete a closed housing assembly for the compressor.

Figure 7:
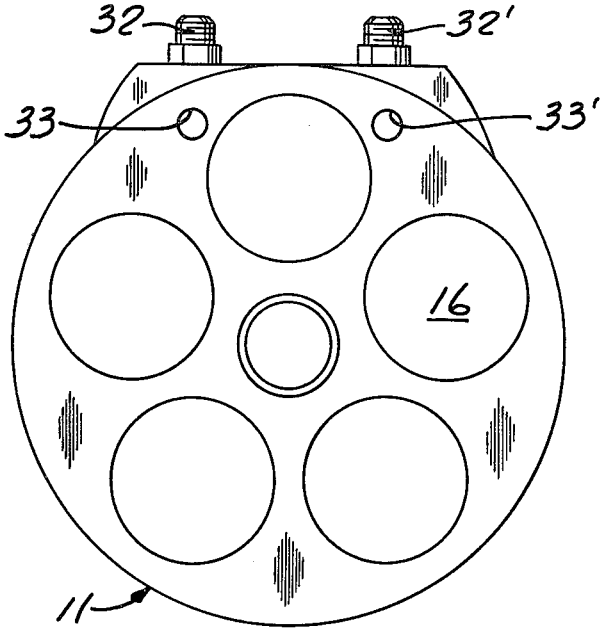
FIG. 7 shows a plan view of a cylinder block in FIG. 1.

The cylinder block 11A is formed with at least one cylinder (five cylinders are shown in FIG. 7) 16, in which a piston 17 is slidably fitted.

In the hollow portion 11B, an input rotor 18 and a wobble plate 19 are disposed. The rotor 18 is secured on an input shaft 20 which is born by a journal bearing 21 in the front cover plate 12, and thus the rotor 18 is rotated by the rotation of the shaft 20.

The front cover plate 12 is formed with a shaft seal cavity 22, in which a shaft seal assembly 21 is mounted to seal the shaft 20 extending in the cavity 22.

The wobble plate 19 is connected with all pistons 17 by connecting rods 24. As disclosed in the above U.S. patents, the wobble plate 19 is maintained against rotation in the housing. A pair of intermeshing gear-like elements 25, 25' is shown but the cross-axis mechanism disclosed in U.S. Pat. No. 3,761,202 may be employed.

Thus, by the rotation of the shaft 20, all pistons 17 are reciprocated in respective cylinders 16, in the known manner.

Between the rotor 18 and the front cover plate 12, a thrust bearing assembly 26, such as the roller or needle bearing type, is mounted and a gap 27 is provided thereby about the shaft 20.

A second gap 28 is provided between the rotor 18 and the wobble plate 19 by the provision of a second thrust bearing assembly 29 therebetween.

The shaft 20 is formed with a hole 201 communicating between the shaft seal cavity 22 and a second gap 29, and also with another hole 202 communicating between the journal bearing 21 and the second gap 28. In the drawing, the hole 201 is bifurcated to form another hole 202.

The front cover plate 12 is formed with at least one hole (two holes are shown in the drawing) 121 which communicates between the seal cavity 22 and the first gap 27.

Figure 2:
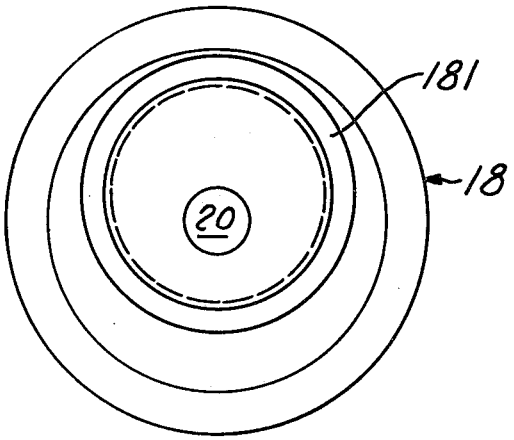
FIG. 2 shows a plan view of an input rotor in FIG. 1.

In the surface of the rotor facing the front cover plate, an annular recess 181 is formed in eccentricity from the shaft 20, as shown in FIG. 2.

Figure 3:
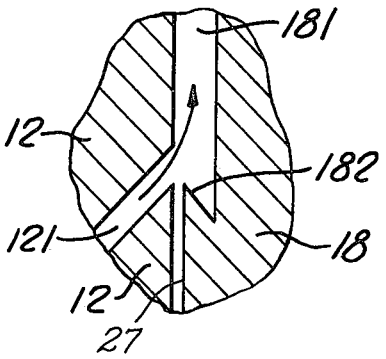
FIG. 3 shows an enlarged view of a portion in FIG. 1.

The edge 182 of radially internal wall of the recess 181 may be formed in a sharp corner to project radially outward as shown in FIG. 3.

In the operation, when the rotor 18 is rotated by the shaft, the lubricant oil in the gap 27 is sent radially outward by the centrifugal action. The centrifugal action is promoted by the eccentric annular recess 181 to pump out the oil from the gap 27 into the sump chamber 11B. Accordingly, the oil in the shaft seal cavity 22 is sucked into the gap 27 through the hole 121 and, therefore, the oil in the sump chamber 11B is sucked into the seal cavity 22 through the second gap 28, holes 201 and 202 and journal bearing 21. Thus, the thrust bearing assemblies 26 and 29, the journal bearing 21, and the shaft seal assembly 23 are lubricated by the oil contained in the sump chamber 11B, without loss of the oil and without any complicated construction and any increase of volume of parts.

The cylinder head 13 is formed with a suction chamber 131 and a discharge chamber 132 which are partitioned by a wall 133, as is well known in the prior art.

The valve plate 14 is formed with suction and discharge openings 141 and 142 in registry with the suction and discharge chambers 131 and 132, respectively, and in registry with each cylinder 16. The valve plate 14 is provided with suction reed valve 143 and discharge reed valve 144 as well known in the prior art. To the discharge reed valve 144, a valve retainer 15 is provided.

Figure 4:
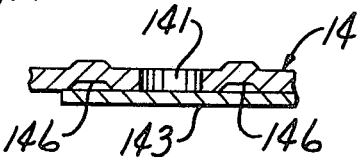
FIG. 4 shows an enlarged partial cross-section of a valve plate in FIG. 1.

The valve plate 14 is formed of a plate having a flat and smooth surface and has a reduced thickness such that it is capable of being punched and pressed. The suction and discharge openings 141 and 142 are formed by punching. Valve relief grooves 146 are formed by pressing as shown in FIG. 4.

As the valve plate 14 is thin and is formed by punching and pressing, the valve plate is economical and results in the reduction of the volume of the compressor and in the improvement of the refrigerant efficiency.

A ground steel plate or a spring steel plate may be employed as the valve plate.

Figure 5:
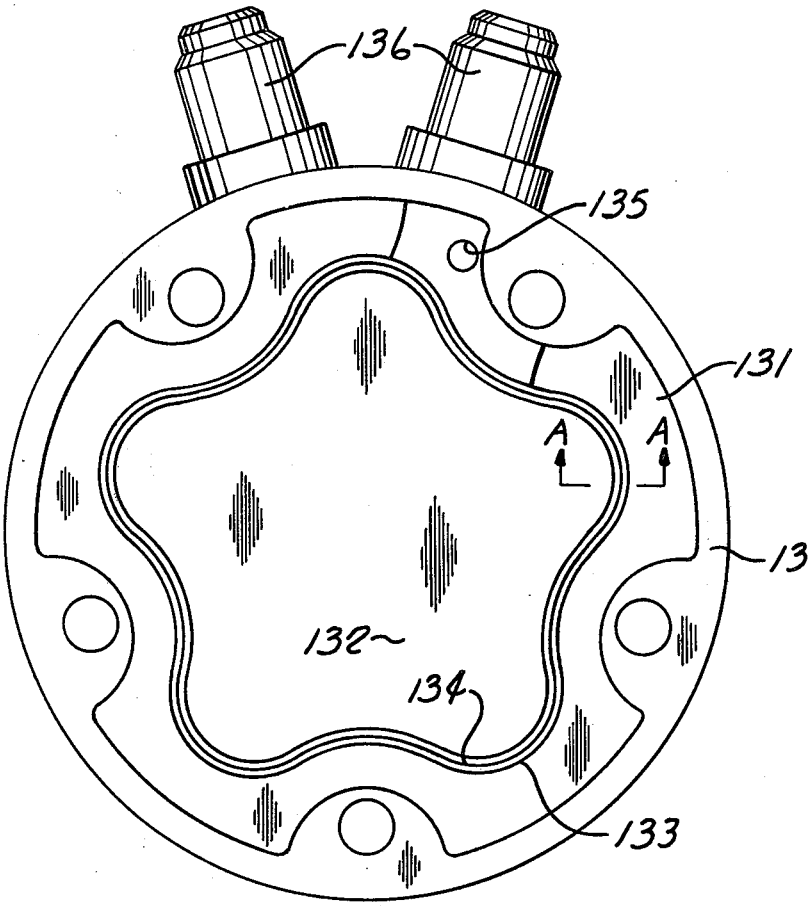
FIG. 5 shows a plan view of a cylinder head in FIG. 1.
Figure 6:
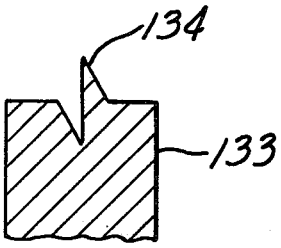
FIG. 6 shows an enlarged partial cross-section taken along line A—A in FIG. 5.

Between the valve plate 14 and the cylinder head 13, gasket members 30 and 31 are secured as is known in the prior art. In order to prevent the gasket 30 from displacing and being broken down due to the increased differential pressure between the suction and discharge chambers 131 and 132, sharp projections are formed on the end surface of the partition wall 133, as shown in FIGS. 5 and 6.

In assembled form, the projections 134 bite into the gasket member 30 to firmly secure the gasket in position.

The compressor may be provided with two service valves connecting with the suction and discharge chambers 131 and 132, which are used for introducing the refrigerant gas into the refrigerant system using the compressor, for making the interior of the compressor vacuous or for other services.

Figure 8:
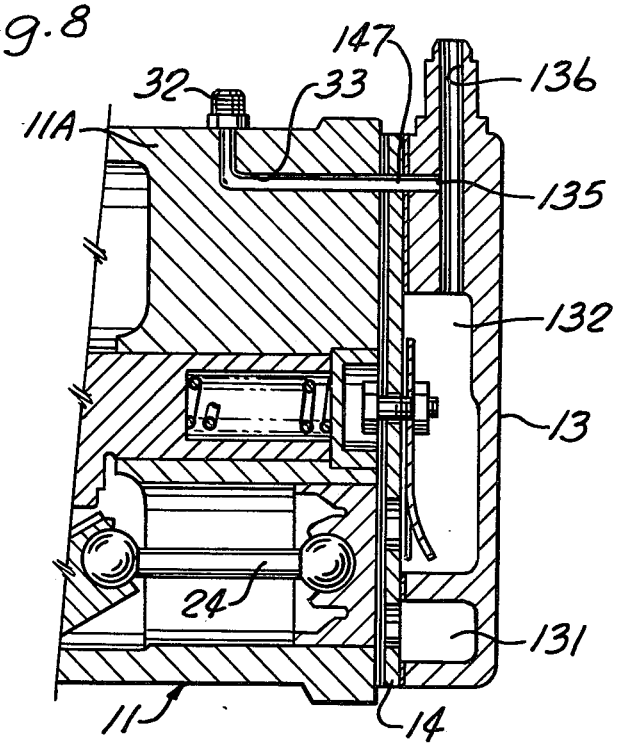
FIG. 8 is a view sectional veiew of the embodiment in FIG. 1, taken along a different line in FIG. 1.

Such service valves 32 and 32' are provided on the side surface of the housing 11, as shown in FIGS. 7 and 8. The cylinder block 11A is formed with holes 33 and 33' extending from the service valves 32 and 32' to the valve plate 14, which is formed with holes 147 communicating the hole 33 and 33' with the discharge chamber 132 and the suction chamber 131, respectively. In the drawing, the cylinder head 13 is formed with hole 135 communicating the hole 147 with a discharge port 136 which is provided through the cylinder head 13 in order to connect the compressor with the refrigerant circuit as is well known in the prior art.

This arrangement of the service valves reduces the axial length of the compressor and results in ready operation of the service valves, particularly, in such narrow space as the engine room of an automobile.

This invention has been described referring to particular embodiments, which do not restrict this invention but various modifications and designations will be made by those skilled in the art within the scope of this invention.

What is claimed is:

1. A refrigerant compressor having at least one piston reciprocated by means of a wobble plate means driven by an input rotor means and an input shaft means connected with said rotor means, a housing for said compressor including a cylinder block for said at least one piston and a sump chamber adjacent said cylinder block housing said wobble plate and said input rotor, a first end plate means on said housing including journal bearing means for bearing said input shaft, a shaft seal cavity and shaft seal means mounted on and around said input shaft in said shaft seal cavity, a second end plate means at the opposite end of said housing including refrigerant suction and discharge chambers and valve means selectively interconnecting the same with said cylinder block, first peripheral bearing means between said input rotor means and said first end plate means, second peripheral bearing means between said input rotor means and said wobble plate means, and lubrication oil contained in said sump chamber, which is characterized in that said input shaft has a first oil flow port extending from a first predetermined oil flow gap between said rotor means and said wobble plate to said shaft seal cavity and a second oil flow port communicating between said first oil flow gap and said journal bearing, said first end plate means including at least one third oil flow port extending from said shaft seal cavity to a second predetermined oil flow gap between said input rotor means and said first end plate means, and said input rotor means having an annular recess which is formed in a surface thereof facing said second oil flow gap and in eccentricity from the rotating axis of said rotor, whereby the lubrication oil flows from said sump chamber to said second oil flow gap by passing through said first oil flow gap, said first and second oil flow ports, said shaft seal cavity and said third oil flow port, said oil being returned to said sump chamber from said second oil flow gap after serving for lubrication of said journal bearing means, said first and second peripheral bearing means and said shaft seal means.

2. The compressor as claimed in claim 1, wherein a radially inner wall edge of said annular recess of said input rotor means projects radially outwardly.

3. The compressor as claimed in claim 1, wherein said second end plate means comprises a cylinder head formed with the suction and discharge chambers which are partitioned by partition wall means, a valve plate which is secured between said cylinder head and said cylinder block and which has inlet openings in registry with said suction chamber and exhaust openings in registry with said discharge chamber, reed valve means provided to said valve plate for control of said inlet openings and of said exhaust openings in response to the operation of said compressor, and gasket means being secured between said valve plate and an end surface of said partition wall means, and wherein said partition wall means being formed with sharp projections which bite into said gasket to firmly secure said gasket.

4. The compressor as claimed in claim 3, wherein said valve plate is formed of a plate having a flat and smooth surface and having a reduced thickness capable of being punched and pressed, said valve plate formed with punched inlet and exhaust openings.

5. The compressor as claimed in claim 4, wherein said valve plate is formed of a thin plate selected from a ground steel plate and a spring steel.

6. The compressor as claimed in claim 5, wherein said valve plate is formed with valve relief grooves means by pressing.

7. The compressor as claimed in claim 3, wherein said cylinder head has an outlet port communicating with said discharge chamber, siad cylinder block having two valve means provided on side surface thereof which are communicated with said suction and discharge chambers, respectively, through holes formed in said cylinder block and said valve plate, to provide service valves.

8. The compressor as claimed in claim 1, wherein said second end plate means comprises a cylinder head formed with the suction and discharge chambers, a valve plate which is secured between said cylinder head and said cylinder block which has inlet openings in registry with said suction chamber and exhaust openings in registry with said discharge chamber, said valve plate being formed of a plate having a flat and smooth surface and having a reduced thickness to be capable of punching and pressing, and being formed with punched said inlet and exhaust openings.

9. The compressor as claimed in claim 8, wherein said valve plate is formed of a thin plate selected from a ground steel plate and a spring steel plate.

10. The compressor as claimed in claim 9, wherein said valve plate is formed with valve relief, grooves by pressing.

11. The compressor as claimed in claim 8, wherein said cylinder head has an outlet port communicating with said discharge chamber, said cylinder block having two valve means provided on side surface thereof which are communicated with said suction and discharge chambers, respectively, through holes formed in said cylinder block and said valve plate, to provide service valves.

12. The compressor as claimed in claim 1, wherein said second end plate means has an outlet port communicating with said discharge chamber, said cylinder block having two valve means provided on side surface thereof which are communicated with said suction and discharge chambers, respectively, through holes formed in said cylinder block to provide service valves.

* * * * *

UNITED STATES PATENT OFFICE

CERTIFICATE OF CORRECTION

PATENT NO. : 3,945,765

DATED : March 23, 1976

INVENTOR(S) : Hiroshi Toyoda, Shigemi Shimizu, Kiyoshi Terauchi, Masaharu Hiraga It is certified that error appears in the above-identified patent and that said Letters Patent are hereby corrected as shown below:

Col. 1, line 50, before "degraded" insert --in--

Col. 1, line 64, after "vided" insert --on--

Col. 2, line 20, delete "being"

Col. 2, line 31, delete "a"

Col. 2, line 61, erase "The" and substitute --for--

Col. 3, line 42, erase "view" and substitute --partial--

Col. 3, line 42, erase "veiew" and substitute --view--

Col. 3, line 64, erase "21" and substitute --23--

Col. 5, line 25, erase "hole" and substitute --holes--

Col. 5, line 37, after "invention" insert --,--

Col. 6, line 14, erase "outwardly" and substitute --outward--

Col. 6, line 27, delete "wherein"

Col. 6, line 44, erase "siad" and substitute --said--

Col. 6, line 45, erase "surface" and substitute --surfaces--

Col. 6, line 65, delete ","

Col. 8, line 2, erase "surface" and substitute --surfaces--

Signed and Sealed this

Sixth Day of July 1976

[SEAL]

*Attest:*

RUTH C. MASON
*Attesting Officer*

C. MARSHALL DANN
*Commissioner of Patents and Trademarks*